US008210863B2

(12) United States Patent
Johnson

(10) Patent No.: US 8,210,863 B2
(45) Date of Patent: Jul. 3, 2012

(54) HYBRID CONNECTOR

(75) Inventor: Brandon Johnson, Bloomingdale, IL (US)

(73) Assignee: PC-Tel, Inc., Bloomingdale, IL (US)

( * ) Notice: Subject to any disclaimer, the term of this patent is extended or adjusted under 35 U.S.C. 154(b) by 344 days.

(21) Appl. No.: 12/617,029

(22) Filed: Nov. 12, 2009

(65) Prior Publication Data

US 2010/0124835 A1 May 20, 2010

Related U.S. Application Data

(60) Provisional application No. 61/115,708, filed on Nov. 18, 2008.

(51) Int. Cl.
*H01R 13/62* (2006.01)

(52) U.S. Cl. ..... 439/314; 439/320; 439/218

(58) Field of Classification Search ..... 439/310–314, 439/318, 320, 218
See application file for complete search history.

(56) References Cited

U.S. PATENT DOCUMENTS

| | | | | |
|---|---|---|---|---|
| 2,540,012 | A | 1/1951 | Salati | |
| 4,440,464 | A * | 4/1984 | Spinner | 439/218 |
| 4,687,446 | A * | 8/1987 | Birch et al. | 439/553 |
| 5,802,710 | A * | 9/1998 | Bufanda et al. | 29/828 |
| 6,062,786 | A * | 5/2000 | Garver et al. | 411/386 |
| 6,921,283 | B2 * | 7/2005 | Zahlit et al. | 439/489 |
| 2005/0186822 | A1 * | 8/2005 | Serino et al. | 439/320 |

* cited by examiner

*Primary Examiner* — Xuong Chung Trans
(74) *Attorney, Agent, or Firm* — Husch Blackwell LLP

(57) ABSTRACT

A hybrid connector for directly connecting with a female BNC connector and a female TNC connector is provided. The hybrid connector includes a pin, a body, and an outer shell. A distal end of the pin is housed in a dielectric, the dielectric is housed in the body, and a proximate end of the body is housed in the outer shell. The outer shell includes a screw thread that advances axially from a proximate end thereof along an interior surface of the outer shell, and first and second bayonet locking mechanisms disposed therein.

20 Claims, 9 Drawing Sheets

HYBRID CONNECTOR

CROSS-REFERENCE TO RELATED APPLICATIONS

This application claims priority to U.S. Provisional Patent Application No. 61/115,708 filed Nov. 18, 2008 titled "Hybrid Connector That Functions as Both a TNC Male Plug and BNC Male Plug."

FIELD OF INVENTION

The present invention relates generally to BNC and TNC connectors. More particularly, the present invention relates to a hybrid connector that can function as both a male BNC connector and a male TNC connector

BACKGROUND

BNC connectors and TNC connectors are known in the art. The United States Department of Defense publishes standards for RF (radio frequency) connectors, such as BNC connectors and TNC connectors. For example, MIL-STD-348 describes certain requirements for a BNC or TNC connector. Although some BNC and TNC connectors are not compliant with MIL-STD-348, many are, and those connectors that are compliant with MIL-STD-348 find a larger marketplace of consumers.

A BNC (Bayonet Neill-Concelman) connector is a type of RF connector for terminating a coaxial cable. For example, a first end of a male BNC connector can mate with a first end of a female BNC connector, and a second end of the male BNC connector can terminate a coaxial cable. The second end of the female BNC connector can be connected to a cable box or other apparatus or device as would be known by those of skill in the art. Accordingly, the connected male and female BNC connectors act as an interface between the coaxial cable and the cable box.

The exterior housing of the male BNC connector includes bayonet locking mechanisms for connecting with the corresponding locking mechanisms of the of the female BNC connector, which may include bayonets or other protrusions extending from the exterior housing of the female BNC connector. To connect the male BNC connector with the female BNC connector, the bayonets of the female connector are aligned with the bayonet locking mechanisms of the male connector. Then, the male connector is rotated relative to the female connector to engage the bayonets in the bayonet locking mechanisms and secure the female BNC connector in place relative to the male BNC connector.

A TNC (Threaded Neill-Concelman) connector is another type of RF connector for terminating a coaxial cable. Like the male BNC connector, the male TNC connector connects with a female TNC connector, and the connection between the male and female TNC connectors acts as an interface between a coaxial cable and a cable box or other device connected to the female TNC connector.

Unlike the male BNC connector, the exterior housing of the male TNC connector includes a threaded interior or screw thread for connecting with a corresponding threaded exterior or screw thread of the female TNC connector. To connect the male TNC connector to the female TNC connector, the threading of the male and female connectors are aligned with one another. Then, the male connector is rotated relative to the female connector until the male connector is fully threaded onto the female connector.

Problems arise when the RF connector terminating a coaxial cable does not match the RF connector associated with a cable box or other device. For example, if a female BNC connector is connected to a cable box, and a male TNC connector terminates the available coaxial cable, the user must use additional equipment, such as a cable assembly, adaptor, or other equipment, to couple the female BNC connector to the male TNC connector. A similar situation arises when a user wishes to connect, for example, a male BNC connector to a female TNC connector.

Using cable assemblies, adaptors, or other equipment to couple mismatching connectors to one another is an expensive and inflexible solution to the problems and disadvantages presented by known RF connectors. Not only must the additional equipment be purchased, but it must be readily available to users working with BNC and TNC connectors.

Accordingly, there is a continuing, ongoing need for a single RF connector that can directly connect to multiple types of RF connectors. Preferably such a connector is a hybrid connector that can function as both a male BNC connector and a male TNC connector and directly connect with both a female BNC connector and a female TNC connector.

DESCRIPTION OF THE PREFERRED EMBODIMENTS

Figure 1:
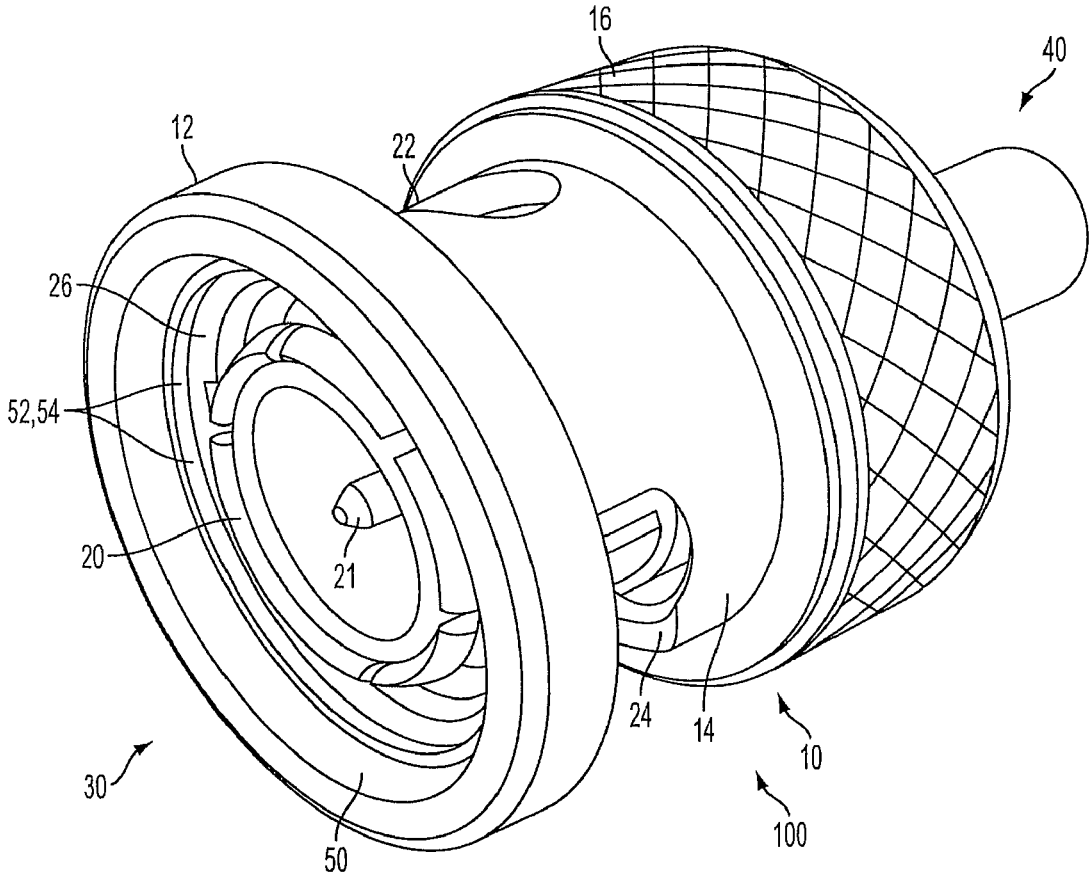
FIG. 1 is a front perspective view of a hybrid connector in accordance with the present invention.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments of the present invention include a hybrid connector that can directly connect to multiple types of RF connectors. For example, a hybrid connector in accordance with the present invention can function as both a male BNC connector and a male TNC connector so that the hybrid connector can directly connect with both a female BNC connector and a female TNC connector.

Figure 2:
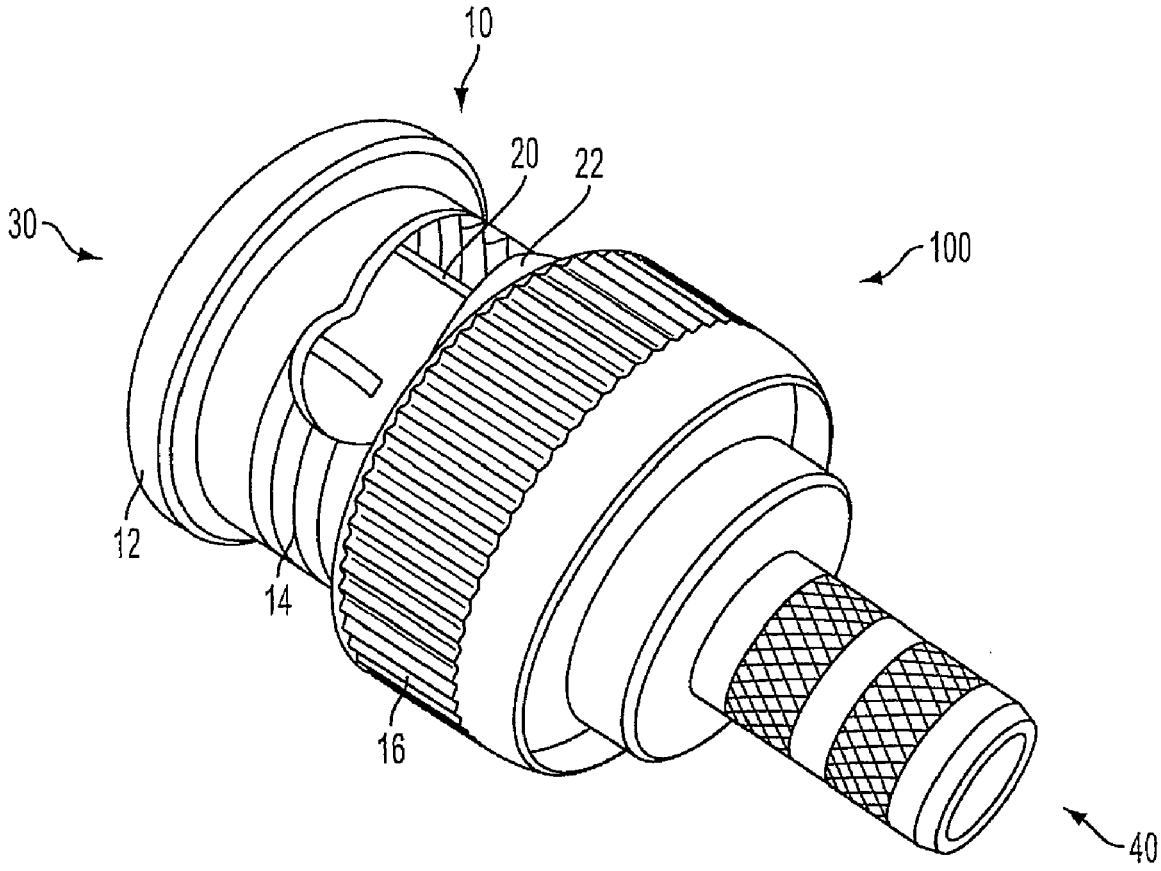
FIG. 2 is a back perspective view of a hybrid connector in accordance with the present invention.

FIG. 1 is a front perspective view a hybrid connector 100 in accordance with the present invention, and FIG. 2 is a back perspective view of the hybrid connector 100 in accordance with the present invention. As seen in FIG. 1 and FIG. 2, the hybrid connector 100 can include a first end 30, a second end 40, a stepped outer shell 10, and an inner shell 20. As known by those of skill in the art, the inner shell 14 can house a male pin 21.

The stepped outer shell 10 can include first, second and third sections 12, 14, and 16, respectively. The first and third sections 12 and 16, respectively, can have substantially identical diameters, and the second section 14 can have a smaller diameter relative to the first and third sections 12 and 16.

The first and second sections 12 and 14 of the outer shell 10 can have threaded interior circumferences. That is, the first and second sections 12 and 14 can include an interior screw thread 26. In embodiments of the present invention, the screw thread 26 can extend axially around the interior circumference of the outer shell 10.

The second section 14 of the outer shell 10 can also have at least first and second bayonet locking mechanisms 22, 24. As will be explained further herein, the interior screw thread 26 of the second section 14 can accommodate the bayonet locking mechanisms 22, 24.

In embodiments of the present invention, the hybrid connector 100 can include a thread relief 50 at the first end 30 of the connector 100 and threading lead-ins, for example 52, 54 at each end of the bayonet locking mechanisms 22, 24. The thread relief 50 can coaxially center the connector 100 relative to a mating RF connector. Further, as will be explained in more detail herein, the thread relief 50 and the threading lead-ins 52, 54 can aid in preventing cross-threading.

Figure 1A:
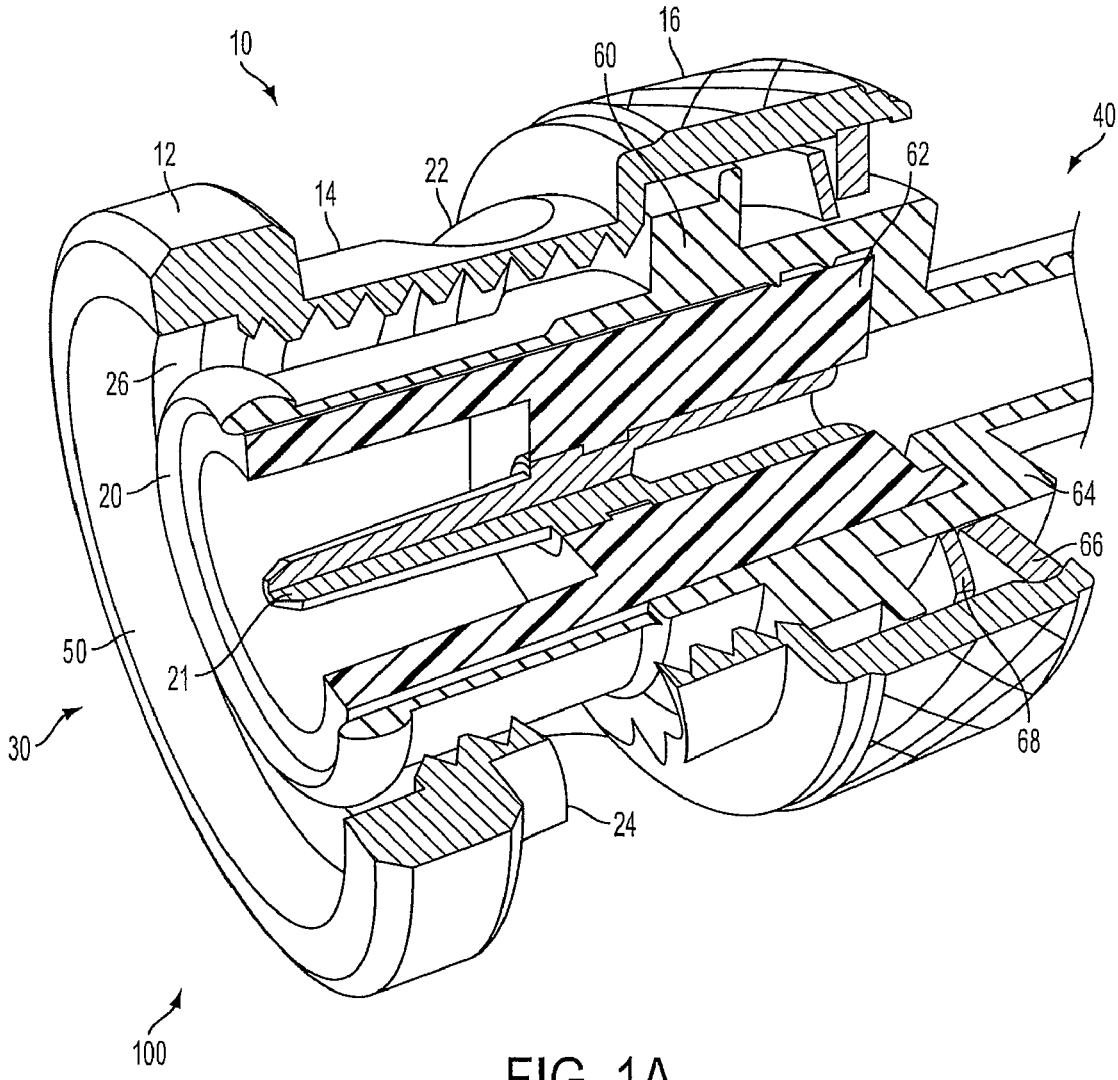
FIG. 1A is a cross-sectional view of a hybrid connector in accordance with the present invention.

FIG. 1A is a cross-sectional view of the hybrid connector 100 in accordance with the present invention. As seen in FIG. 1A, a distal end of the pin 21 can be housed in a dielectric 62. The dielectric 62 can be housed in a body 64 of the connector 100. In embodiments of the present invention, the body 64 can be a distal end of the inner shell 20 of the connector 100.

In embodiments of the present invention, a sealing gasket 60 and/or a retaining wall 66 can be disposed between the body 66 and the third section 16 of the outer shell 10. Both the sealing gasket 60 and the retaining wall 66 can aid in waterproofing the connector 100 and the various elements thereof.

In further embodiments of the present invention, a wavespring 68 can be axially disposed between the sealing gasket 60 and the retaining wall 66 and between the body 66 and the third section 16 of the outer shell 10. The wavespring 68 can cause the outer shell 10, dielectric 62, and pin 21 to move together through the compression range (20%-30%) of the connector 100. Accordingly, when the connector 100 mates with a second RF connector, the pin 21 is not damaged and the sealing gasket 60 is not compromised. Further, the wavespring 68 can ensure that the connector 100 is compressed consistently.

Figure 3:
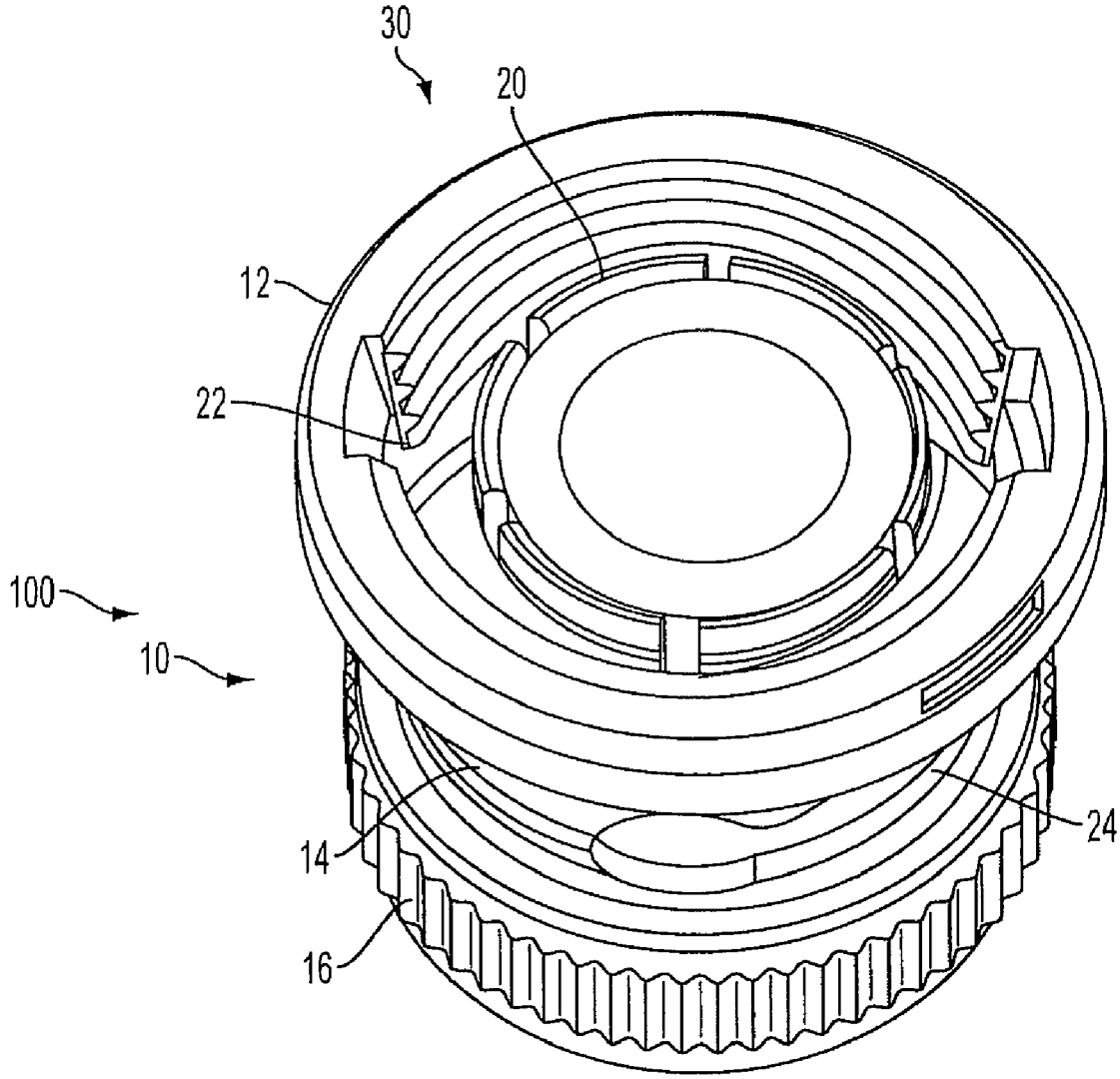
FIG. 3 is a first end view of a hybrid connector in accordance with the present invention.

FIG. 3 is a first end view of the hybrid connector 100 in accordance with the present invention. The first end 30 of the hybrid connector 100 can receive either a female BNC connector or a female TNC connector for the hybrid connector 100 to connect thereto.

For example, to connect a female BNC connector with the hybrid connector 100 in accordance with the present invention, an outer shell of the female BNC connector can be inserted into the outer shell 10 of the hybrid connector 100. The exterior portion of the female BNC connector known in the art includes connecting bayonets or other protrusions extending therefrom. The connecting bayonets of the female BNC connector can be aligned with the bayonet locking mechanisms 22, 24 of the hybrid connector 100. Then, the hybrid connector 100 can be rotated relative to the female BNC connector to engage the connecting bayonets of the female BNC connector with the bayonet locking mechanisms 22, 24 of the hybrid connector 100. Thus, the hybrid connector 100 can be lockingly secured to the female BNC connector.

Figure 5:
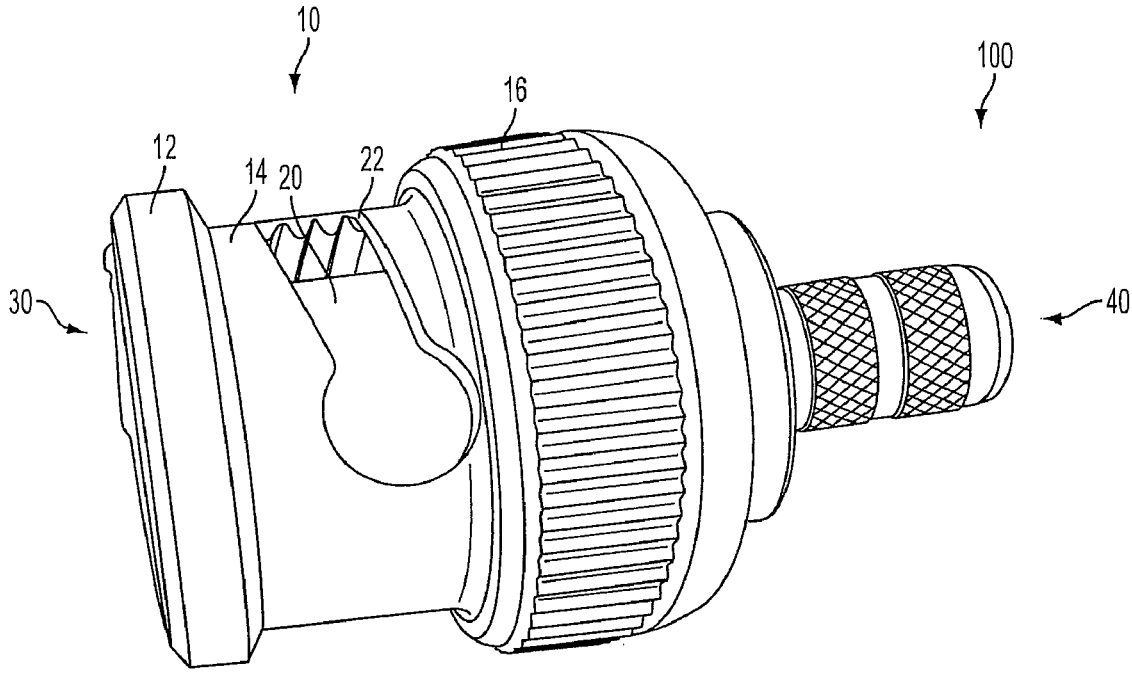
FIG. 5 is a first side view of a hybrid connector in accordance with the present invention.
Figure 6:
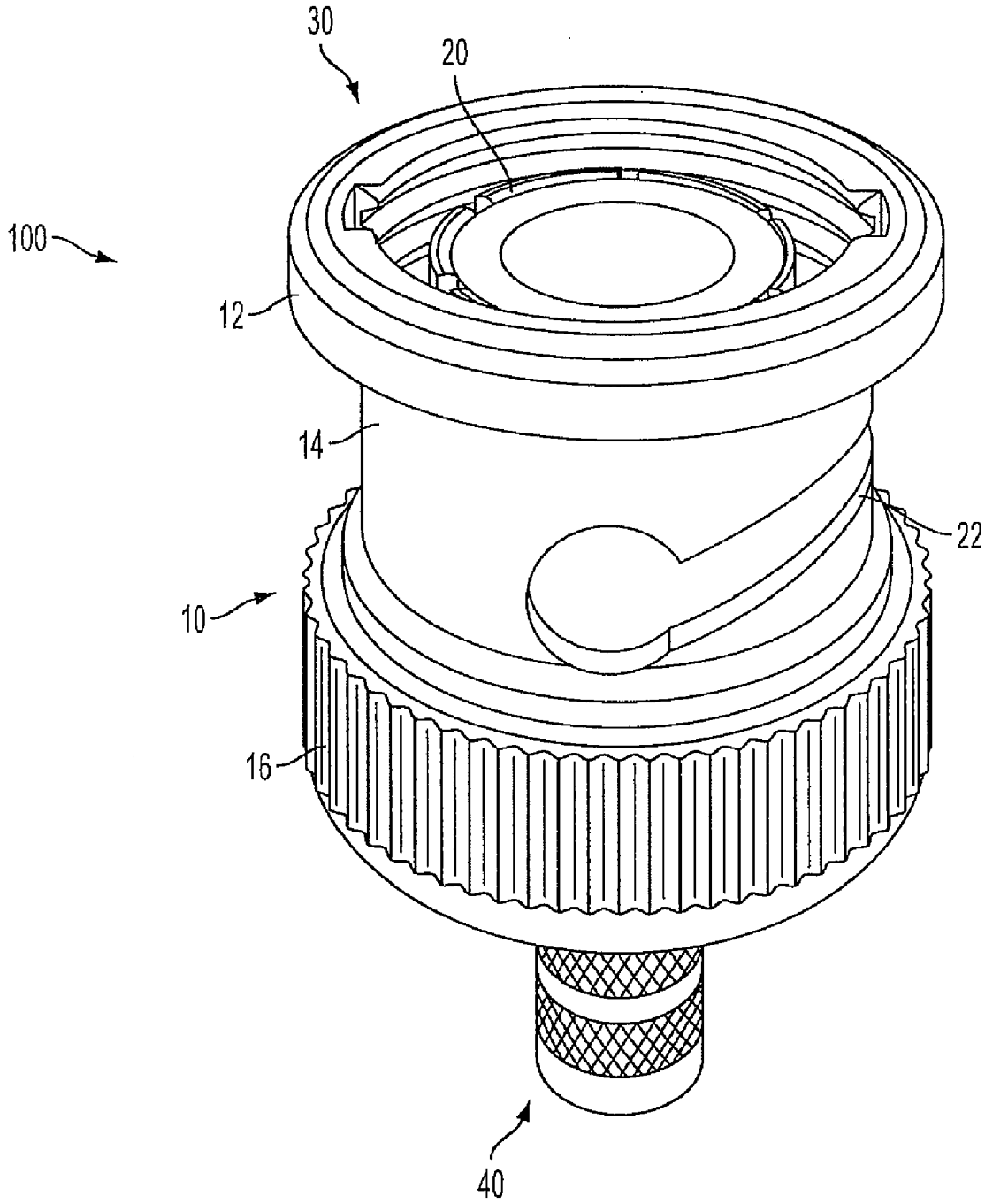
FIG. 6 is a second side view of a hybrid connector in accordance with the present invention.
Figure 7:
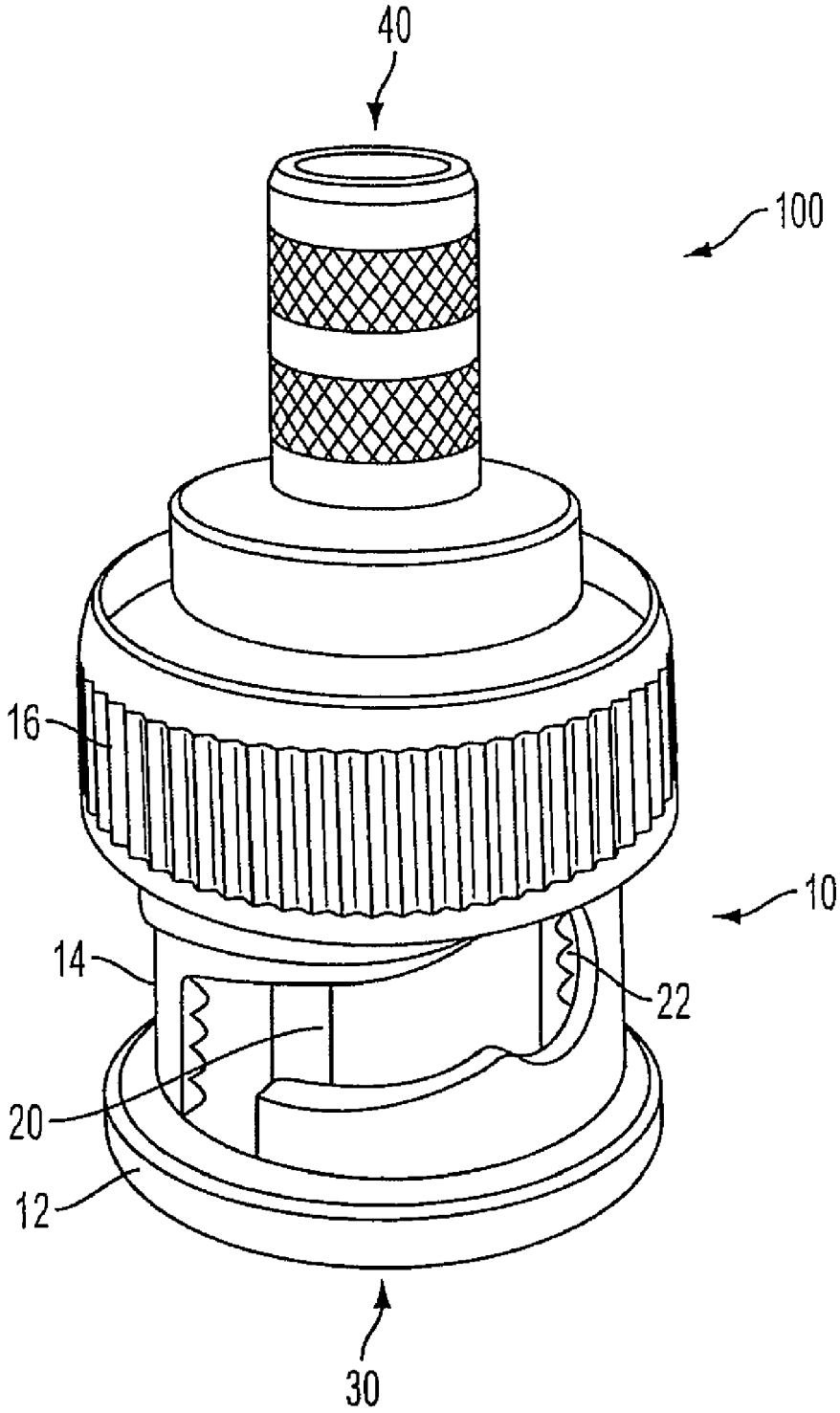
FIG. 7 is a third side view of a hybrid connector in accordance with the present invention.

As best seen in FIG. 5, FIG. 6, and FIG. 7, a bayonet locking mechanism 22, 24 in accordance with the present invention can be disposed in the second section 14 of the outer shell 10. Each bayonet locking mechanism 22, 24 can include an axially extending slot for receiving a connecting bayonet of a female BNC connector. The connecting bayonet can move along the axially extending slot as the hybrid connector 100 is rotated relative to the female BNC connector.

A recess is disposed at a distal end of each axially extending slot for securing the connecting bayonet in the bayonet locking mechanism 22, 24. When the connecting bayonet reaches the distal end of the axially extending slot, the recess can receive the connecting bayonet and prevent the bayonet from disengaging from the bayonet locking mechanism 22, 24, absent user intervention. The wavespring 68 can aid in compressing the connector 100 to engage and disengage the connecting bayonets with the bayonet locking mechanisms 22, 24.

The threaded interior circumference of the outer shell 10 does not interfere with the female BNC connector when the hybrid connector 100 engages the female BNC connector. The female BNC connector does not include a threaded surface so substantially no portion of the female BNC connector engages the threaded interior circumference of the hybrid connector 100.

To connect a female TNC connector with a hybrid connector 100 in accordance with the present invention, an outer shell of the female TNC connector can be screwed into the outer shell 10 of the hybrid connector 100. The outer shell of the female TNC connector known in the art includes a threaded exterior or screw thread that advances axially from a first end of the female TNC connector. As explained above, the outer shell 10 of the hybrid connector includes a threaded interior or screw thread 26 that advances axially from the first end 30 of the connector 100.

The female TNC connector can be placed at the first end 30 of the connector 100, and the thread relief 50 can aid in centering the female TNC connector relative to the hybrid connector 100. Then, the exterior screw thread of the female TNC connector can engage the interior screw thread 26 of the hybrid connector 100 as the hybrid connector 100 is rotated relative to the female TNC connector. Because the thread relief 50 at the first end 30 of the connector 100 centers the female TNC connector before it engages the hybrid connector 100, cross-threading is minimized and/or eliminated.

In embodiments of the present invention, a thread relief, such as a stopping or locking mechanism, can be disposed at a distal end of the screw thread 26. When the exterior screw thread of the female TNC connector engages the distally disposed thread relief, the hybrid connector 100 is prevented from rotating further relative to the female TNC connector. Thus, the hybrid connector can be lockingly secured to the female TNC connector.

In embodiments of the present invention, the distally disposed thread relief of the hybrid connector can ensure proper engagement of the interfacing contacts: the male pin of the hybrid connector 100 and the female contact of the female TNC connector. The thread relief can prevent the hybrid connector from screwing too far onto the female TNC connector, which can damage the interfacing contacts.

As best seen in FIG. 5, FIG. 6, and FIG. 7, the interior screw thread 26 of the hybrid connector 100 can accommodate the bayonet locking mechanisms 22, 24 disposed in the outer shell 10 of the hybrid connector 100. As explained above, the threaded interior circumference of the hybrid connector 100 includes a screw thread 26 that advances axially from the first end 30 of the connector 100. The screw thread 26 continues to extend axially on the interior circumference of the outer shell 10 despite the presence of the bayonet locking mechanisms 22, 24.

That is, each thread of the screw thread 26 terminates at first ends of each bayonet locking mechanism 22, 24, and each thread of the screw thread commences at second ends of each bayonet locking mechanism 22, 24. The commencing threads of the screw thread 26 are aligned along the interior circumference of the outer shell 10 as if the bayonet locking mechanisms 22, 24 were not present. That is, the commencing threads of the screw thread 26 are axially located in the same position that the threads would be located if the screw thread 26 continuously spanned across each bayonet locking mechanism 22, 24.

Accordingly, the bayonet locking mechanisms 22, 24 do not interfere with the female TNC connector when the hybrid connector 100 is screwed onto the female TNC connector. When the interior screw thread 26 of the hybrid connector 10 is rotated relative to the exterior screw thread of the female TNC connector, substantially no cross-threading occurs.

In embodiments of the present invention, threading lead-ins 52, 54 can be disposed at the first and second ends of each bayonet locking mechanism 22, 24. The threading lead-ins 52, 54 further minimize and/or eliminate cross-threading as the screw thread 26 rotates relative to an exterior screw thread of a female TNC connector.

Figure 4:
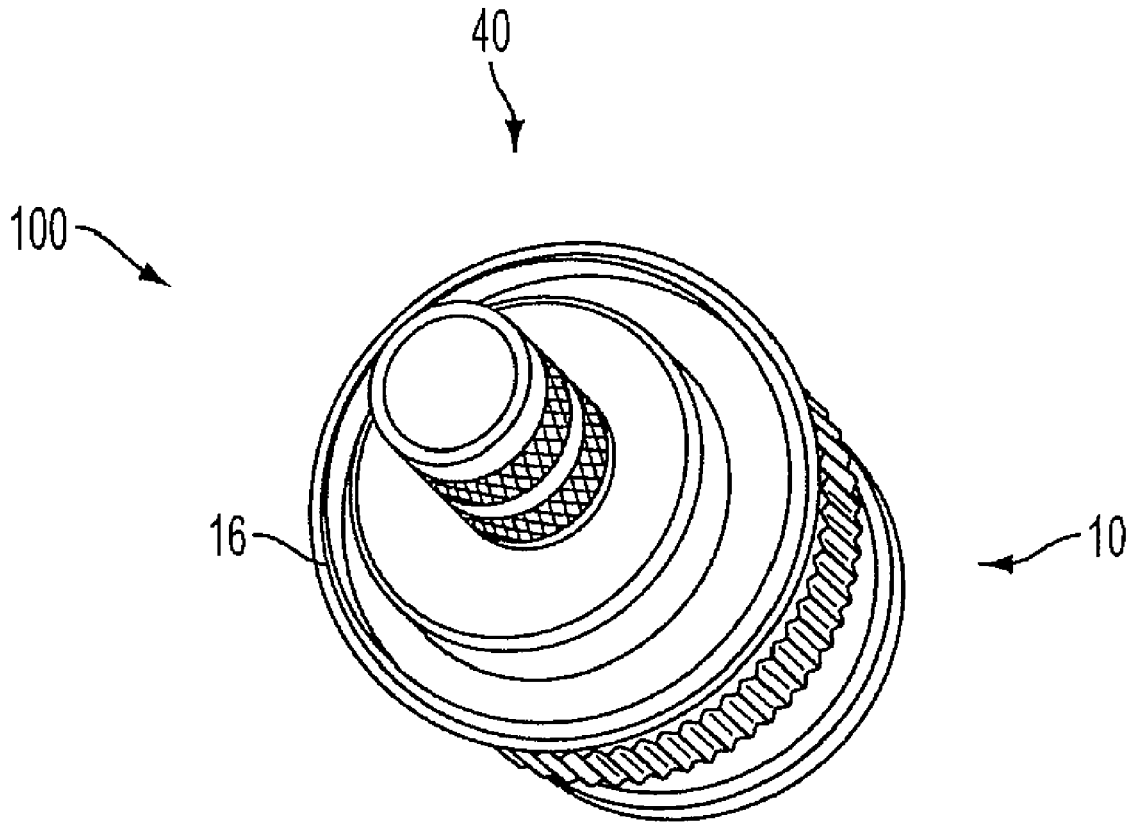
FIG. 4 is a second end view of a hybrid connector in accordance with the present invention.

FIG. 4 is a second end view of the hybrid connector 100 in accordance with the present invention. The second end 40 of the hybrid connector 100 can terminate a coaxial cable as would be known by those of skill in the art.

Figure 8:
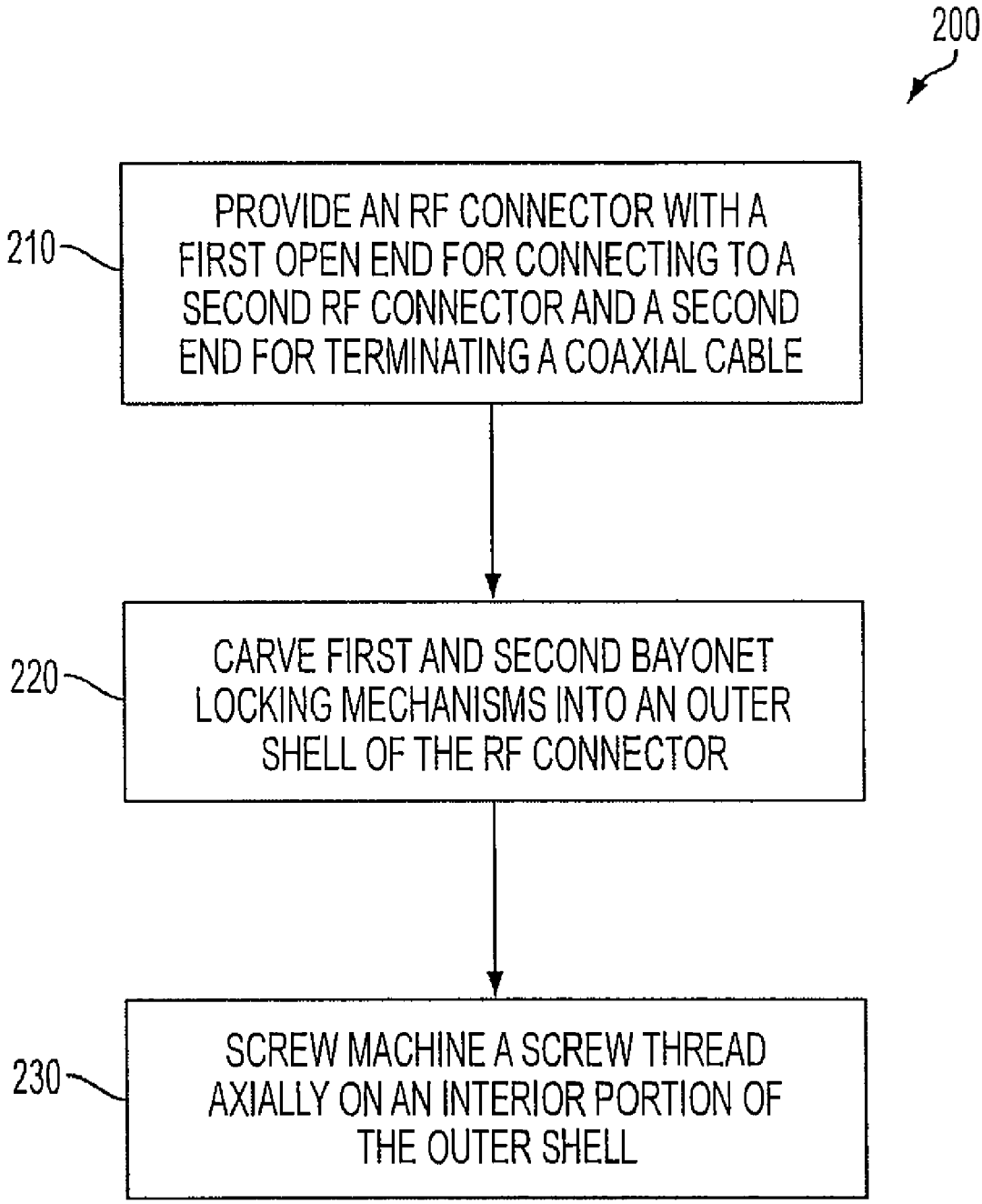
FIG. 8 is a flow diagram of a method of manufacturing a hybrid connector in accordance with the present invention.

FIG. 8 is a method 200 of manufacturing a hybrid connector 100 in accordance with the present invention. In the method 200, an RF connector is provided as in 210. The RF connector includes a first open end for connecting to a second RF connector and a second end for terminating a coaxial cable.

First and second bayonet locking mechanisms are carved into the outer shell of the RF connector as in 220. The first and second bayonet locking mechanisms can be disposed on opposing sides of the RF connector and be shaped for receiving, engaging, and securing connecting bayonets of a female BNC connector.

After the first and second bayonet locking mechanisms are carved into the outer shell of the RF connector as in 220, a screw thread can be axially screw machined on the interior portion of the outer shell of the RF connector as in 230. The screw thread can be machined so that it axially spans the bayonet locking mechanisms disposed in the outer shell of the RF connector and prevents cross-threading.

When manufacturing the RF connector in accordance with the present invention, the outer shell of the connector must have a thickness that is thick enough to accommodate the interior screw thread, but thin enough to accommodate the bayonet locking mechanisms disposed therein. Further, the bayonet locking mechanisms must be disposed in the outer shell at consistent and precise locations so that no cross-threading occurs when the screw thread is screw machined onto the interior portion of the outer shell.

The hybrid connector 100 shown and described herein can be in compliance with MIL-STD-348. That is, the hybrid connector 100 in accordance with the present invention can comply with the standards set forth in MIL-STD-348 for both male BNC connectors and male TNC connectors. Further, the method of making the hybrid connector 100 shown and described herein can be in compliance with MIL-STD-348.

From the foregoing, it will be observed that numerous variations and modifications may be effected without departing from the spirit and scope of the invention. It is to be understood that no limitation with respect to the specific system or method illustrated herein is intended or should be inferred. It is, of course, intended to cover by the appended claims all such modifications as fall within the spirit and scope of the claims.

What is claimed is:

1. A hybrid connector for directly connecting with a female BNC connector and a female TNC connector comprising:

a pin, a distal end of the pin housed in a dielectric;

a body housing the dielectric; and an outer shell housing a proximate end of the body, wherein the outer shell includes a screw thread that advances axially from a proximate end thereof along an interior surface of the outer shell, wherein the outer shell includes first and second bayonet locking mechanisms disposed through the outer shell, and wherein the screw thread terminates at first ends of the bayonet locking mechanisms and commences at second ends of the bayonet locking mechanisms.

2. The hybrid connector as in claim 1 wherein the proximate end of the body and the outer shell are capable of receiving a female BNC connector or a female TNC connector.

3. The hybrid connector as in claim 1 further comprising a thread relief disposed at the proximate end of the outer shell.

4. The hybrid connector as in claim 1 further comprising a threading lead-in disposed at first and second ends of each bayonet locking mechanism.

5. The hybrid connector as in claim 1 further comprising a sealing gasket disposed between the body and the outer shell.

6. The hybrid connector as in claim 1 further comprising a retaining wall disposed between the body and the outer shell.

7. The hybrid connector as in claim 1 further comprising a wavespring disposed between the body and the outer shell.

8. The hybrid connector as in claim 1 wherein the first and second bayonet locking mechanisms are disposed in opposing sides of the outer shell.

9. The hybrid connector as in claim 1 wherein each bayonet locking mechanism includes an axially extending slot and a recess disposed at a distal end of the axially extending slot.

10. The hybrid connector as in claim 9 wherein the axially extending slot is capable of receiving a bayonet of a mating connector, and the recess is capable of securing the bayonet in the recess.

11. The hybrid connector as in claim 1 further comprising a thread relief disposed at a distal end of the screw thread.

12. The hybrid connector as in claim 1 wherein the screw thread is aligned across the first and second bayonet locking mechanisms to prevent cross-threading.

13. The hybrid connector as in claim 12 further comprising a threading lead-in disposed at first and second ends of each bayonet locking mechanism.

14. The hybrid connector as in claim 1 wherein the outer shell includes a thickness suitable for accommodating the first and second bayonet locking mechanisms and the screw thread.

15. The hybrid connector as in claim 1 wherein the hybrid connector is compliant with MIL-STD-348.

16. A method of manufacturing a hybrid connector for directly connecting with a female BNC connector and a female TNC connector comprising:

providing an RF connector that includes a first open end for connecting to a second RF connector and a second end for terminating a coaxial cable;

carving first and second bayonet locking mechanisms through an outer shell of the RF connector; and screw machining a screw thread on an interior portion of the outer shell, the screw thread extending axially from the open end of the RF connector, the screw thread terminating at first ends of the bayonet locking mechanisms and commencing at second ends of the bayonet locking mechanisms.

17. The method as in claim 16 wherein carving first and second bayonet locking mechanisms through an outer shell of the RF connector includes carving the first and second bayonet locking mechanisms through opposing sides of the RF connector.

18. The method as in claim 16 wherein carving first and second bayonet locking mechanisms through an outer shell of the RF connector includes carving an axially extending slot and a recess disposed at a distal end of the axially extending slot.

19. The method as in claim 16 wherein screw machining a screw thread on an interior portion of the outer shell includes aligning the screw thread across the first and second bayonet locking mechanisms to prevent cross-threading.

20. An outer shell of a radio frequency connector comprising:

a screw thread that advances axially from a proximate end of the outer shell along an interior surface of the outer shell; and first and second bayonet locking mechanisms disposed through the outer shell, wherein the screw thread terminates at first ends of the bayonet locking mechanisms and commences at second ends of the bayonet locking mechanisms.

* * * * *